US010854965B1

(12) United States Patent
Livadaru et al.

(10) Patent No.: US 10,854,965 B1
(45) Date of Patent: Dec. 1, 2020

(54) GROUND SHIELD TO ENHANCE ISOLATION OF ANTENNA CARDS IN AN ARRAY

(71) Applicant: BAE SYSTEMS INFORMATION AND ELECTRONIC SYSTEMS INTEGRATION INC., Nashua, NH (US)

(72) Inventors: Matilda Livadaru, Bedford, NH (US); Andrew C. Maccabe, Milford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 15 days.

(21) Appl. No.: 16/277,200

(22) Filed: Feb. 15, 2019

(51) Int. Cl.

| | |
|---|---|
| ***H01Q 9/16*** | (2006.01) |
| ***H01Q 1/52*** | (2006.01) |
| ***H01Q 21/00*** | (2006.01) |
| ***H01Q 1/38*** | (2006.01) |

(52) U.S. Cl.
CPC ..... *H01Q 1/526* (2013.01); *H01Q 1/38* (2013.01); *H01Q 21/0075* (2013.01); *H01Q 9/16* (2013.01)

(58) Field of Classification Search
CPC ..... H01Q 21/0075; H01Q 9/16
USPC ..... 343/821, 859
See application file for complete search history.

(56) References Cited

U.S. PATENT DOCUMENTS

| | | | | |
|---|---|---|---|---|
| 4,737,797 | A * | 4/1988 | Siwiak | H01Q 9/065 333/26 |
| 5,191,351 | A | 3/1993 | Hofer et al. | |
| 6,011,524 | A | 1/2000 | Jervis | |
| 7,408,515 | B2 | 8/2008 | Leisten | |
| 7,573,349 | B2 | 8/2009 | Rauch | |
| 7,772,941 | B2 | 8/2010 | Yeung et al. | |
| 9,583,841 | B2 | 2/2017 | Forslund et al. | |
| 9,716,312 | B2 | 7/2017 | Chen et al. | |
| 9,837,721 | B2 * | 12/2017 | Huynh | H01Q 9/285 |
| 2007/0063787 | A1 | 3/2007 | Rauch | |
| 2007/0063902 | A1 | 3/2007 | Leisten | |
| 2009/0309672 | A1 | 12/2009 | Yeung et al. | |
| 2014/0302807 | A1 * | 10/2014 | Lee | H01Q 21/065 455/272 |

(Continued)

FOREIGN PATENT DOCUMENTS

| | | |
|---|---|---|
| EP | 2599161 | 1/2016 |
| WO | 2018138111 | 8/2018 |

*Primary Examiner* — Thuy Vinh Tran

(74) *Attorney, Agent, or Firm* — Sand, Sebolt & Wernow LPA; Scott J. Asmus

(57) ABSTRACT

A ground shield is connected to a princted circuit board or antenna card in an antenna unit cell to cover a balun to prevent or inhibit the ability of a differential signal flowing towards or through the balun from coupling with a similar differential signal flowing through an adjacent antenna card in the antenna unit cell. This ground shield may be one of a pair of ground shields on the antenna card. Two ground shield can be positioned on opposing sides of the balun to enhance isolation thereof by shielding the differential signals flowing towards and through the balun from coupling with adjacent differential signals to thereby increase bandwidth performance of the antenna unit cell. The ground shields may be generally or substantially or totally planar so as to be conformal with a substrate or dielectric layer of the antenna card or printed circuit board.

19 Claims, 8 Drawing Sheets

(56) References Cited

U.S. PATENT DOCUMENTS

| | | | | |
|---|---|---|---|---|
| 2016/0308284 | A1 | 10/2016 | Forslund et al. | |
| 2019/0140364 | A1 * | 5/2019 | Mirmozafari ..... | H01Q 21/24 |

* cited by examiner

GROUND SHIELD TO ENHANCE ISOLATION OF ANTENNA CARDS IN AN ARRAY

TECHNICAL FIELD

The present disclosure relates generally to antenna arrays having a plurality of antenna cards arranged in a particular manner to define the array. More particularly, the antenna cards have grounded or ground shields on or covering at least a portion of a surface of the antenna card. The grounded or ground shields enhance isolation of each respective card in the array so as to reduce the likelihood or otherwise inhibit the ability of signals moving through an electrically conductive element on the antenna card from coupling within a signal flowing through another electrically conductive element on an adjacent antenna card.

BACKGROUND

Background Information

An antenna often requires a balun, i.e. a transition from an unbalanced transmission line (e.g. micro stripline feed or a coaxial line) to a balanced line. Often such a transition involves, or even requires, an impedance transformer. One exemplary usage is in a phased array antenna, such as implemented in printed circuit board (PCB) technology.

One simple example of an antenna device which requires a balun is an ordinary dipole wire antenna fed by a coaxial transmission line. A poor dipole antenna can be created by "peeling off" a bit of the screen and the dielectric at the end of a coaxial wire, bending the center conductor to an angle of 90 degrees and attaching an approximately equally long wire pointing in the opposite direction. Such a dipole will however induce common mode currents on the outside of the cable screen resulting in unwanted radiation although it might be well matched at some frequency. A balun is necessary to transform an unbalanced signal to a balanced signal, or vice versa, with minimum power loss and reduce common mode currents to obtain a more "pristine" radiation pattern. However, since that type of dipole antenna is narrowband, only a narrowband balun is required.

In designing electronic circuits, e.g. mixers or amplifiers, balun antennas are used to link a symmetrical or balanced circuit with an asymmetrical or unbalanced circuit. Thus, a balun can be used to change an unbalanced signal to a balanced signal in order to drive a balanced antenna element, or vice versa. One exemplary typical type balun antenna is a Marchand type balun which has an unbalanced input and a balanced output. The input goes to two coupled line sections, the lengths of which are $\lambda/4$ (a quarter wavelength) of the input signal. The portions of the line sections that are connected to the outputs are shorted to ground. The portions of the line sections that are connected to the input are connected to an open circuit (OC). The Marchand balun operates through the coupling that occurs between the lines. Some proffer that the Marchand balun offers good amplitude balance and phase difference with a relatively wide operating bandwidth.

SUMMARY

Issues continue to exist with currently available antenna elements realized on PCBs. One challenge with wideband apertures or antennas in general is the need for a balun. As mentioned above, the balun is a transformer that takes a single ended signal and transforms it into a differential signal. Wideband antenna topology prefers to be differential because some class of antenna topology, which may include tightly coupled dipole arrays (TCDAs), is a dipole which by its nature is differential. Wideband apertures often refer to a cluster of radiating elements. Currently, baluns operate on more narrow bands than would typically be desired. Further, when differential signals are fed into the balun through a micro strip line or a stripline feed, the signals have a tendency to couple with other differential signals flowing through an adjacent stripline feed on another adjacent antenna card or printed circuit board (PCB). Therefore, an exemplary feature of the present disclosure is to increase the bandwidth of the balun to match the available bandwidth of the antenna aperture. Thus, a need continues to exist for a bandwidth that can be expanded or increased using current balun topology by preventing or inhibiting the differential signals flowing to a balun from coupling to another differential signal in an adjacent antenna card in an antenna unit cell.

In accordance with an exemplary aspect of the present disclosure, a ground shield enhances the isolation of each balun in a tightly coupled dipole array antenna assembly. In accordance with one aspect of the present disclosure, when the ground shield is embodied as copper or another metal, the ground shield covers both side of the printed circuit board (PCB) substrate to create a shield around the signal line or stripline feed. In accordance with one aspect of the present disclosure, the copper or metal ground shield is on both sides of the PCB. The ground shield may be in electrical communication with the balun. In one particular embodiment, PCB is a multilayer PCB with the ground shields located on the outermost layers of each side and being connected to the balun with vias to electrically couple the ground shield to the balun. In one embodiment, at least one shield may be formed from a unibody monolithic piece of metallic material that has a wider width at the top and a narrower width towards the bottom. In one particular embodiment, the horizontal shoulder extends inwardly such that a short horizontal edge is orthogonal to the outer edges of the lower narrow portion and the outer edges of the upper wider portion. Each ground shield is connected with vias to create a common ground. Thus, the two grounded shields reference the same ground signal, and the ground connection can be near the bottom of the ground plane.

In one aspect, an exemplary embodiment of the present disclosure may provide an antenna element comprising: a radiating element; a balun connected to the radiating element; a first ground shield covering the balun adapted to enhance isolation of the balun so as to not interfere with other baluns on adjacent antenna elements. This exemplary embodiment or another exemplary embodiment may further provide a signal line coupled to the balun feeding a signal to the balun, wherein the ground shield is operative to shield the signal from coupling with other signals from other signal lines feeding signals to other baluns on adjacent antenna elements. This exemplary embodiment or another exemplary embodiment may further provide antenna element that is operative in a frequency band having a limited number or no spurious resonant signals as a result of the ground shield enhancing isolation of the balun and signal line relative to other adjacent baluns and signal lines. This exemplary embodiment or another exemplary embodiment may further provide a second ground shield covering the balun on an opposing side of the balun than the first ground shield. This exemplary embodiment or another exemplary embodiment may further provide a first major surface area and a second major surface of the first ground shield, and a minor surface area of the first ground shield defined by a thickness of the first ground shield from the first major surface area to the second major surface area forming an edge; and a first major surface area and a second major surface of the second ground shield, and a minor surface area of the second ground shield defined by a thickness of the second ground shield from the first major surface area to the second major surface area forming an edge. This exemplary embodiment or another exemplary embodiment may further provide wherein the second major surface area of the first ground shield faces the first major surface area of the second ground shield. This exemplary embodiment or another exemplary embodiment may further provide wherein the first ground shield comprises copper. This exemplary embodiment or another exemplary embodiment may further provide a trace line that electrically connects the first ground shield to the balun. This exemplary embodiment or another exemplary embodiment may further provide a second ground shield covering the balun on an opposing side of the balun than the first ground shield; a first trace line that electrically connects the first ground shield to the balun; and a second trace line that electrically connects the second ground shield to the balun. This exemplary embodiment or another exemplary embodiment may further provide a first end and a second end of the first ground shield, wherein the first end of the first ground shield is wider than the second end of the first ground shield. This exemplary embodiment or another exemplary embodiment may further provide that the first end of the first ground shield is associated with a top of the first ground shield and the second end is associated with a bottom of the first ground shield. This exemplary embodiment or another exemplary embodiment may further provide a shoulder on the first ground shield that extends inwardly to define a horizontal edge, wherein the first ground shield is wider above the shoulder and narrower below the shoulder. This exemplary embodiment or another exemplary embodiment may further provide outer edges of the first ground shield that are orthogonal to the shoulder, wherein the outer edge of the first ground shield above the shoulder are spaced apart wider than the outer edge of the first ground shield below the shoulder. This exemplary embodiment or another exemplary embodiment may further provide a common ground; a second ground shield covering the balun on an opposing side of the balun than the first ground shield; wherein both the first ground shield and the second ground shield are electrically connected to the common ground. This exemplary embodiment or another exemplary embodiment may further provide that the common ground is associated with a lower end of the antenna element. This exemplary embodiment or another exemplary embodiment may further provide a first resistive feed arm connected to a first differential on the balun; a second resistive feed arm connect to a second differential on the balun; wherein the first ground shield covers both the balun and the first and second resistive feed arms. This exemplary embodiment or another exemplary embodiment may further provide a second ground shield covering the balun on an opposing side of the balun than the first ground shield; a differential signal line; a first portion of dielectric material between the first ground shield and the differential signal line; a second portion of dielectric material between the differential line and the balun; and a third portion of dielectric material between the balun and the second ground shield. This exemplary embodiment or another exemplary embodiment may further provide at least one common ground electrically connecting the first ground shield to the second ground shield; a first via electrically connected to a first differential on the balun; a second via electrically connecting a second differential on the balun to the differential signal line. This exemplary embodiment or another exemplary embodiment may further provide that, when viewed in cross section, a width of the differential signal line that is different than a width of the balun.

In another aspect, an exemplary embodiment of the present disclosure may provide a ground shield that is connected to a printed circuit board or antenna card in an antenna unit cell to cover a balun to prevent or inhibit the ability of a differential signal flowing towards or through the balun from coupling with a similar differential signal flowing through an adjacent antenna card in the antenna unit cell. This ground shield may be one of a pair of ground shields. Two ground shield can be positioned on opposing sides of the balun to enhance isolation thereof by shielding the differential signals flowing towards and through the balun from coupling with adjacent differential signals to thereby increase bandwidth performance of the antenna unit cell. The ground shields may be generally or substantially or totally planar so as to be conformal with a substrate or dielectric layer of the antenna card or printed circuit board.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

FIG. 1-FIG. 8 depict aspects and elements of one antenna card 12 that forms a portion of an antenna element 10 or antenna unit cell 10 (FIG. 9) in accordance with one aspect of the present disclosure. The antenna element 10 or antenna unit cell 10 (FIG. 9) may be coupled with a plurality of similarly fabricated antenna elements/unit cells to form an antenna array. As used herein, an antenna card refers to the circuits and other elements such as a printed circuit board that are coupled to the antenna elements.

Figure 7:
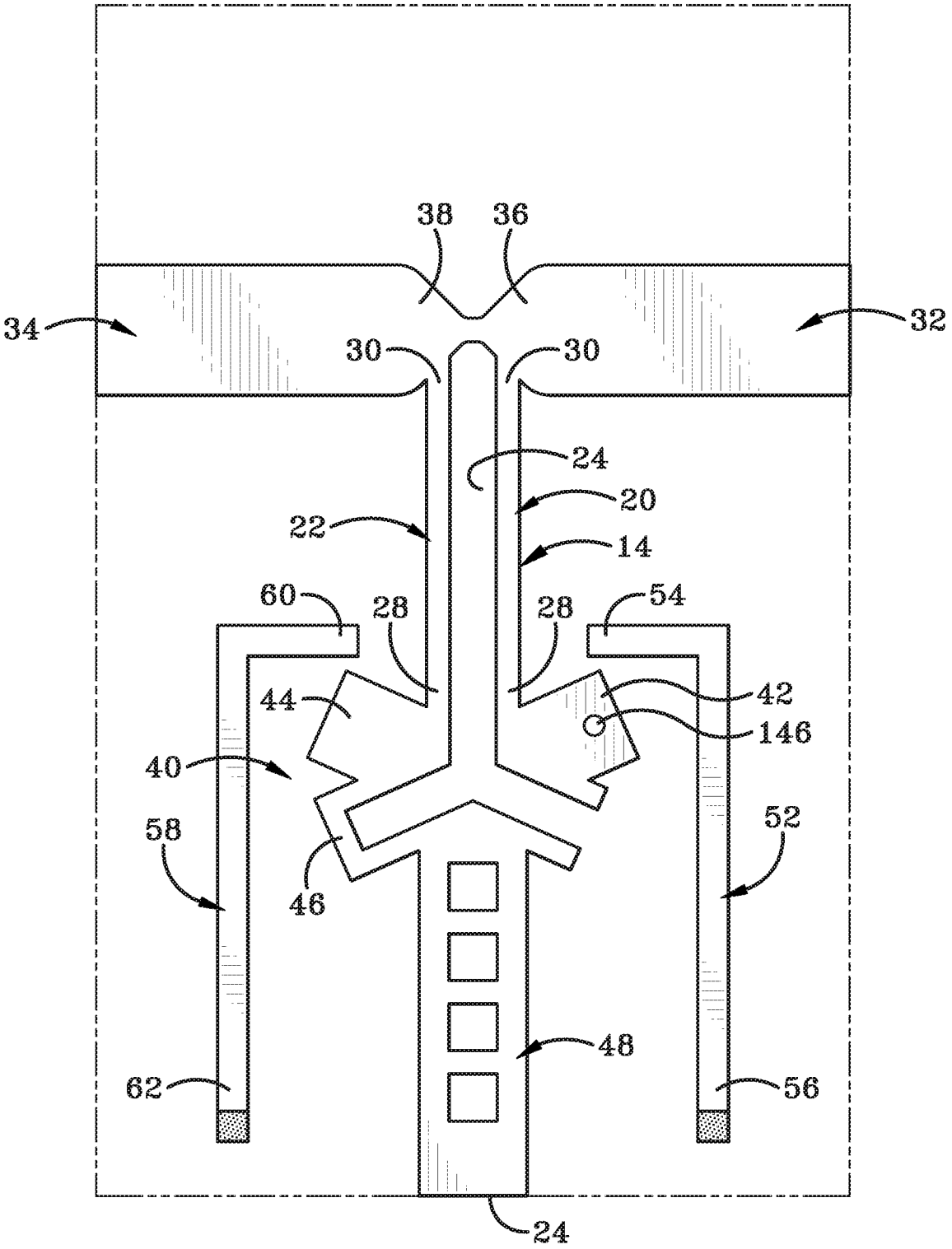
FIG. 7 is an elevational section view of the antenna card taken along line 7-7 in FIG. 4.

The antenna card 12 includes a balun 14 attached to a substrate 16. In one particular example, the balun 14 is a double-y balun attached adjacent a first side surface 18A defining a major surface area of the substrate 16. In one particular embodiment, and as described in greater detail below, the balun 14 is embedded within the substrate 16 between the first side (or front) surface 18A and an opposing second side (or rear) surface 18B. With particular reference to FIG. 7, the balun 14 includes a first differential transmission line 20 and a second differential transmission line 22. The first and second differential transmission lines 20, 22 are spaced apart and generally parallel defining a gap 24 therebetween. The first and second differential transmission lines 20, 22 are connected to the substrate 16, and in one particular embodiment, extend in the direction from the bottom end 26 of the second substrate 16. Each differential transmission line 20, 22 includes a lower end 28 and an upper end 30. The upper end 30 of the first differential transmission line 20 and the second differential transmission line 22 are electrically connected with the respective portions of a first dipole element arm 32 and a second dipole element arm 34. More particularly, the upper end 30 of the first differential transmission line 20 is electrically connected with an inner end 36 of the first dipole element arm 32 on substrate 16. The upper end 20 of the second differential transmission line 32 is electrically connected with an inner end 38 of the second dipole element arm 34 on substrate 16.

Near the lower end 28 of each transmission line 20, 22 is a tuning stub 40. The tuning stub 40 includes a first stub 42 connected with the first differential transmission line 20 and a second stub 44 connected with the second differential transmission line 22, and a third stub 46 connected with the second differential transmission line 22 and the second stub 44. The tuning stub 40 is positioned and closely proximate the lower end 28 of each of the respective differential transmission lines 20, 22.

Balun 14 includes and defines a first major surface that is bound by the edges of the first differential transmission line 20 and the second differential transmission line 22, as well as the tuning stub 40, the first stub 42, the second stub 44, and the third stub 46. Collectively, the edges bounding the aforementioned components define a first major surface area of balun 14. A second major surface area opposes the first major surface area and faces an opposite direction established by the opposing side of the balun 14. As will be described in greater detail below, first and second major surface areas of balun 14 face other components within the antenna card 12. As will be described in greater detail below, one or multiple ground shields may be positioned such that they are substantially parallel offset from the first and second major surfaces of the balun 14. More particularly, there may be a first ground shield that is substantially parallel to a first major surface of the balun 14 which is adapted to enhance isolation of the balun 14 by reducing a likelihood that a signal transmitting through the balun couples with signals transmitting through other baluns on adjacent antenna elements or cards. Additionally, there may be a second ground shield that is substantially parallel to a second major surface of the balun 14 on an opposing side of the balun 14 than the first ground shield. The structures and components of the ground shields will be introduced and described in greater detail below.

A signal input 48 is in operative communication with the tuning stub 40 adjacent the third stub 46. The signal input 48 is configured to receive an input signal there along from a signal source. In one particular embodiment, the signal source may be fed through the power divider. However, any signal source may be utilized. The tuning stub 40 and the signal input 48 are electrically conductive elements that are integrally formed with the second differential transmission line 22. Accordingly, tuning stub 40 and the signal input 48 may be implanted on the first surface 18 or in the substrate 16. The tuning stub 40 on the balun 14 may include two shorts and two opens that are used to tune the balun 14.

A common ground strip 50 extends along the width of the substrate 16 and is electrically connected between each one of a plurality of antenna unit cells forming a row on antenna array. The common ground strip 50 is electrically connected adjacent the input 48 so as to provide a ground for the circuit of the antenna array.

A first rejection or resistance loop 52 includes a first end 54 closely adjacent the first differential transmission line 20 and a second end 56 coupled with the common ground strip 92. A second rejection loop 58 includes a first end 60 proximate the second end differential transmission line 22 and a second end 62 coupled with the common ground strip 50. The rejection loops 52, 58 remove scan anomalies. Thus, when the phase is changed between adjacent dipole radiating arms 32, 34, the rejection loops 52, 58 remove the inefficiencies, such as the spikes in the VSWR. The rejection loops 52, 58 that extend out from the differentials may be copper traces that provide some resistance for mitigation of the common mode. Whenever there is a differential output, there is a common mode that will be generated. The common modes defined by the arms extending out from the differentials create the resonances that are undesirable.

Figure 1:
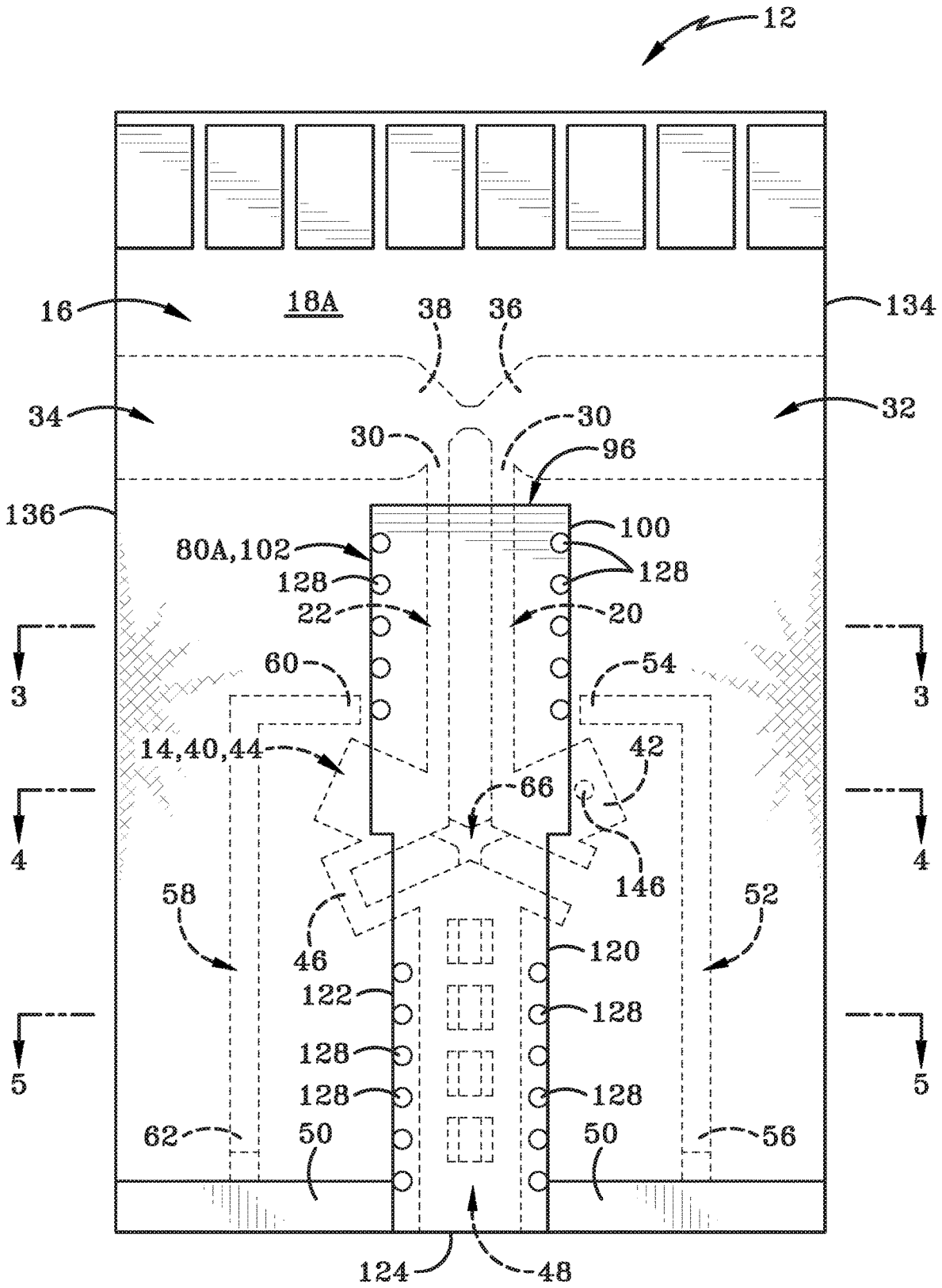
FIG. 1 is a front elevation view of one antenna card in accordance with one aspect of the present disclosure.
Figure 2:
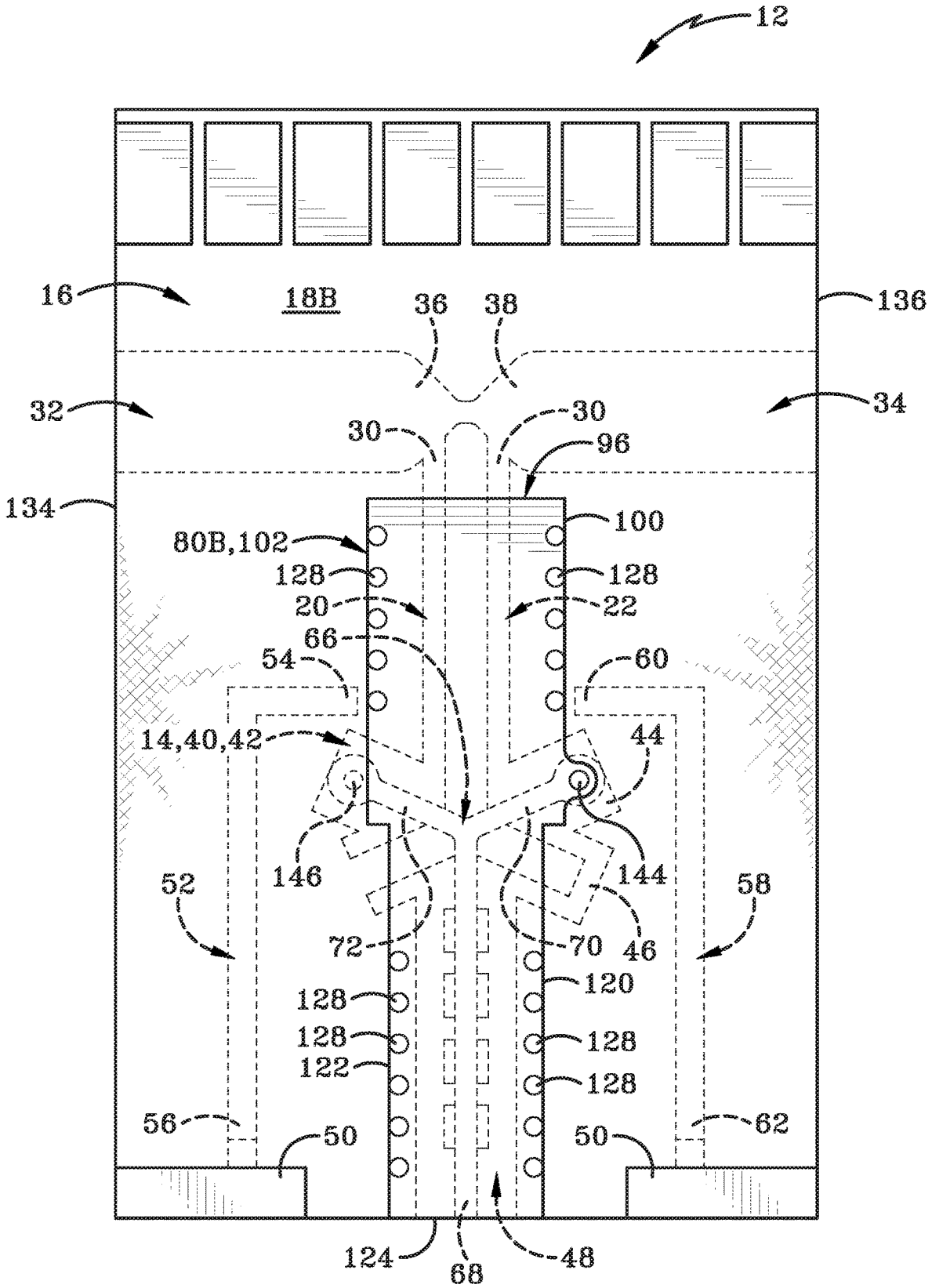
FIG. 2 is a rear elevation view of the antenna card.
Figure 8:
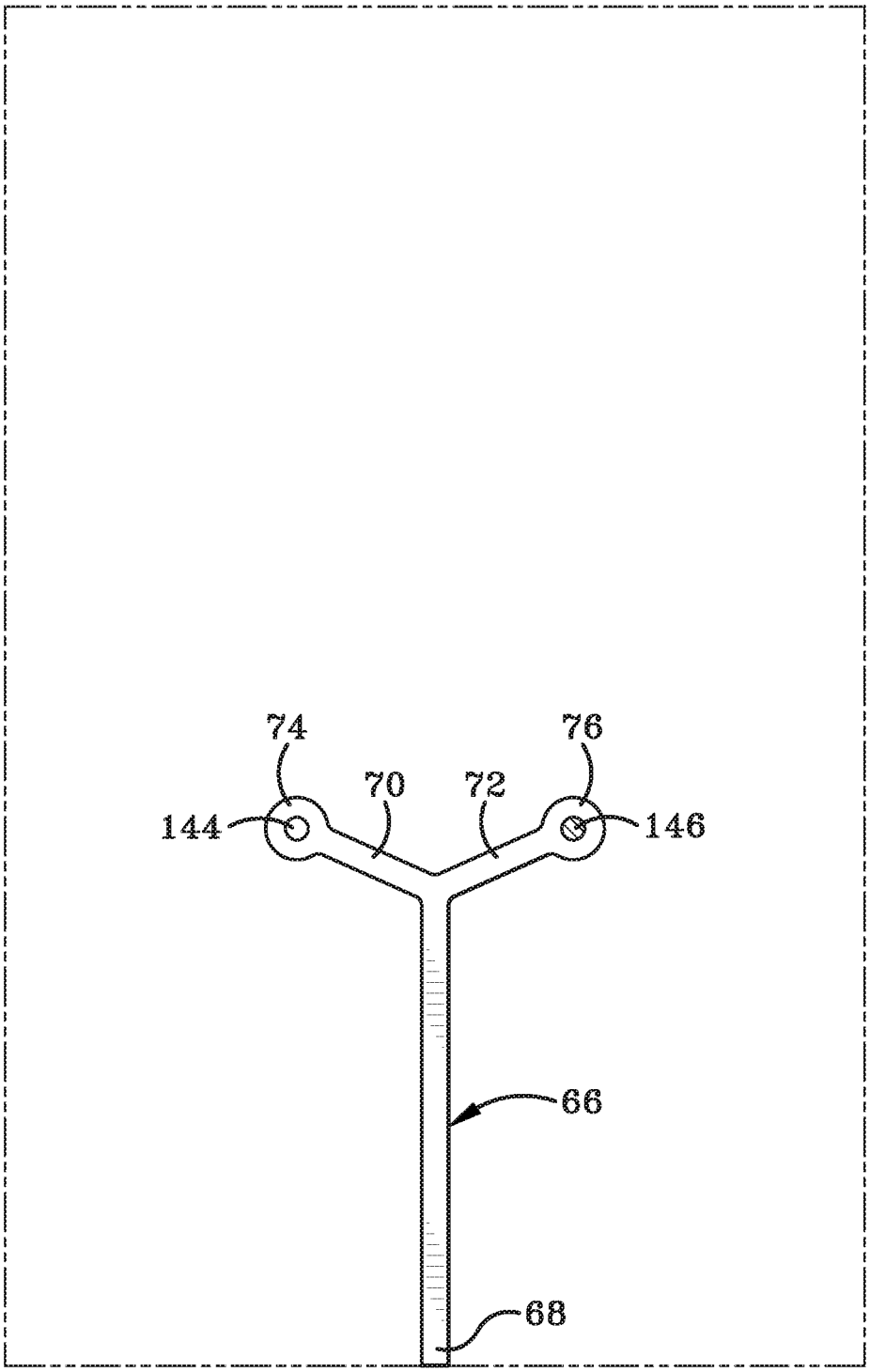
FIG. 8 is an elevational section view of the antenna card taken along line 8-8 in FIG. 4.

FIG. 2 and FIG. 8 depict an unbalanced stripline feed 66 that is carried on or within the substrate 16. The stripline feed 66 is generally a Y-shaped monolithic unibody member formed from a conductive material having a lower end 68 that extends along a central access in a generally linear manner and is bifurcated into first and second arms 70, 72 that terminate at a rounded terminal 74 and 76 respectively. In one particular embodiment, the first terminal 74 on the first arm 70 has a greater width measured through the center of the terminal 74 than that of the first arm 70. Similarly, the second terminal 76 on the second arm 72 has a greater arm width measured through the center of the second terminal 76 than that of the second arm 72. As will be described in greater detail below, the lower end 68 of the stripline feed 66 is configured to lie adjacent or above the input 48 on balun 14. Additionally, first terminal 74 connected with first arm 70 is configured to be positioned above first stub 42 and the second terminal 76 on the second arm 72 is configured to be positioned above or near the second stub 44 on the balun 14.

Figure 3:
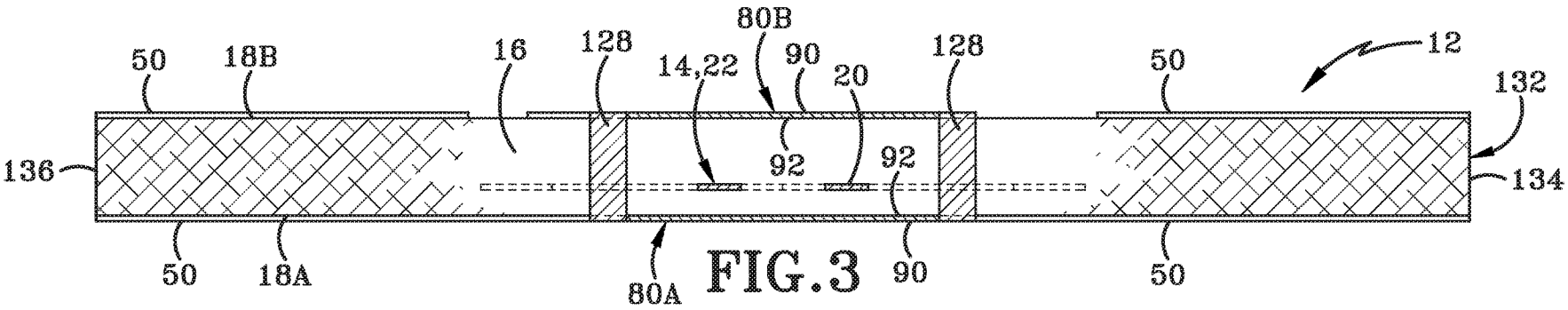
FIG. 3 is a transverse cross section view of the antenna card taken along line 3-3 in FIG. 1.

In accordance with one aspect of the present disclosure, antenna card 12 includes a ground shield 80. Ground shield 80 may be a first ground shield, 80A and there may be a second ground shield 80B (FIG. 2) disposed on an opposite side of the card 12 from the first ground shield 80A. Each ground shield 80A, 80B may be constructed identical to the other ground shields and similar reference elements are used to describe each ground shield 80A, 80B for brevity. Each ground shield 80 is a generally electrically conductive unibody monolithic member having an upper end 82 opposite a lower end 84 defining a vertical or first direction therebetween. Ground shield 80 is a substantially planar or flat member. In one particular embodiment, the ground shield 80 does not include or is otherwise free from any convex or concave surfaces, which is are what are typically found on ground shields of coax cables. Each ground shield 80 includes a first side 86 opposite a second side 88 that define a horizontal direction therebetween. Each ground shield 80 includes a first major surface area 90 opposite the second major surface area 92 (FIG. 3). The major surface areas 90, 92 are bound by outer edges of the ground shield 80 and are substantially planar. The surface area 90 lies along a plane that is offset parallel to another plane along which the surface area 92 lies.

Figure 5:
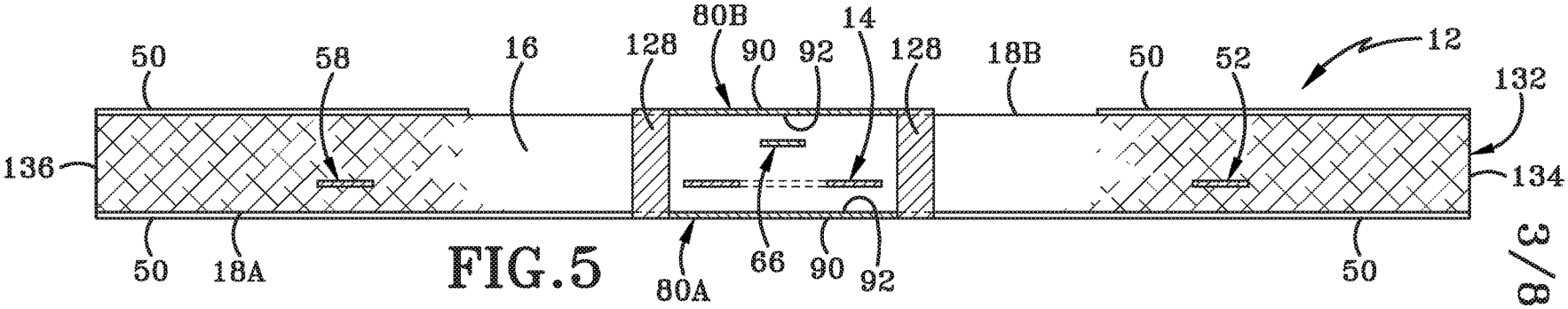
FIG. 5 is a transverse cross section view of the antenna card taken along line 5-5 in FIG. 1.
Figure 6:
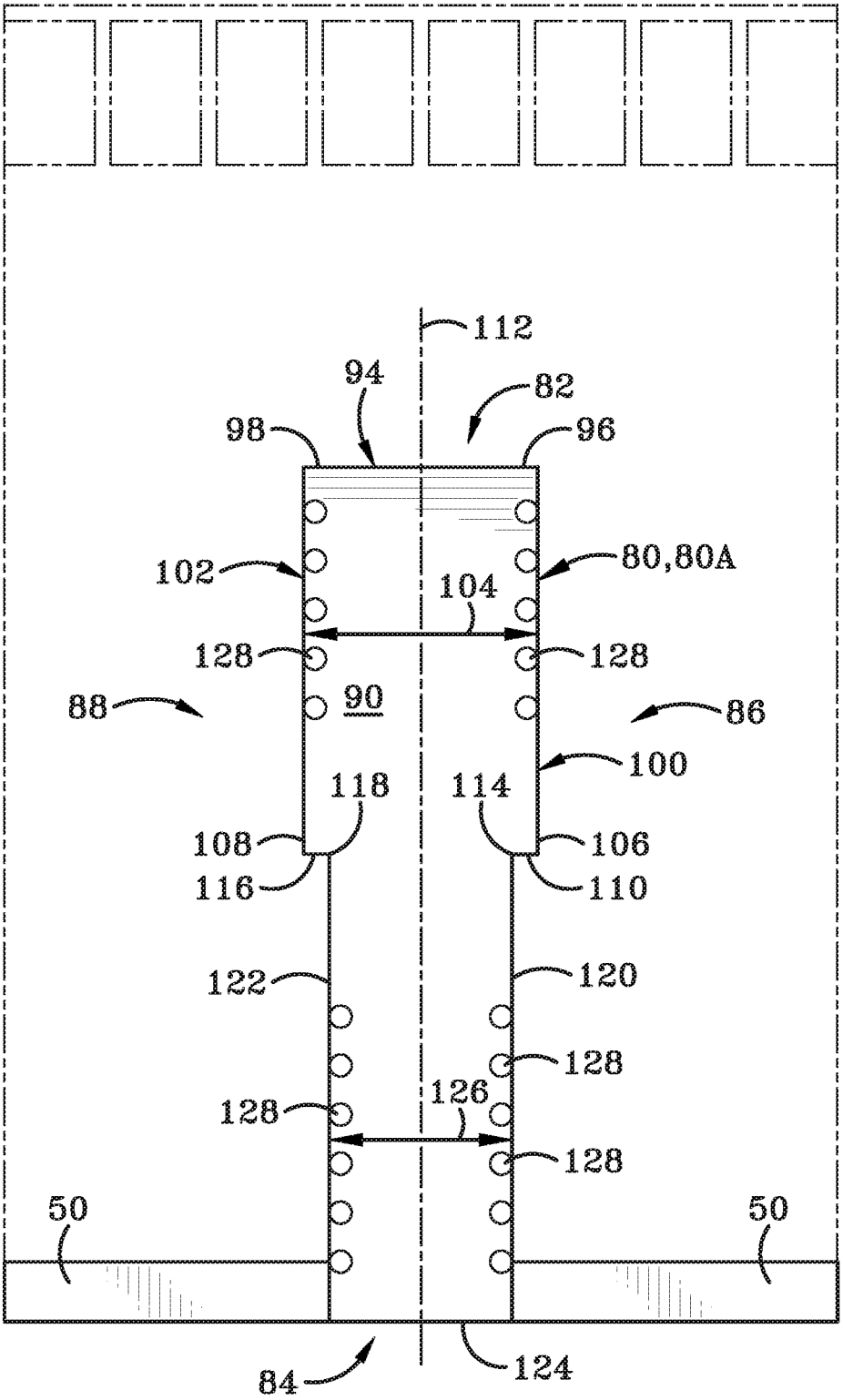
FIG. 6 is an elevational section view of the antenna card taken along line 6-6 in FIG. 4.

More particularly with respect to each ground shield 80, and upper horizontal edge 94 extends horizontally between a first end 96 and a second end 98 to define the upper end 82 of the ground shield 80. An outer first edge 100 extends downward from an orthogonal or perpendicular connection with the first end 96 of the upper edge 94. An outer second edge 102 extends downward offset parallel from the outer first edge 100 downward from the second end 98 of the upper edge 94. A first horizontal width 104 of the ground shield 80 is defined between parallel outer edges 100, 102. Each outer edge 100, 102, terminates at a respective lower end 106, 108. A first intermediate horizontal edge 110 extends inwardly towards a centerline 112 from an orthogonal connection with the lower end 106 of outer first edge 100. Intermediate first horizontal edge 110 terminates at an inner end 114 that does not intersect the centerline 112. An intermediate second horizontal edge 116 extends inwardly from an orthogonal connection with the lower end 108 of outer second edge 102. Intermediate horizontal second edge 116 terminates at an inner end 118 that it stops short of the centerline and does not intersect the same. A lower edge 120 extends downward from the inner end 114 of intermediate first horizontal edge 110 and is spaced apart offset parallel to the centerline 112. A second lower edge 122 extends downward from an orthogonal connection with the inner end 118 of second edge 116. A lower horizontal edge 124 orthogonally intersects the lower ends of lower edges 120, 122 to define the lower end 84 of the ground shield 80. A second narrower dimension 126 is defined as a width of the ground shield 80 between the lower edge 120 and the second lower edge 122. Collectively, the edges described above bound the first major surface area 90 of the ground shield 80. Additionally, the edges described above bound the second major surface area 92 on an opposite side of the ground shield 80. Because the ground shield 80 is formed as a unibody monolithic unitary member, a small or slight minor surface area may be defined based on the thickness of the ground shield 80 between the first major surface area and the second major surface arc area 92. Stated otherwise, the interconnection of the edges 94, 100, 102, 110, 116, 120, 122, and 124 may define a minor surface area of the ground shield based on the thickness thereof between the major surface areas 90, 92. FIG. 5 depicts an assembled plan view of the card 12 having the first ground shield 80A covering an outer surface 18 of the substrate 16. While not shown in FIG. 5, it is to be understood that the second ground shield 80B covers a portion of an opposite surface of the substrate 16 on the opposing side thereof. A plurality of electrically conductive ground connectors 128 may be electrically connected with the first ground shield 80 and extend transversely through the card 12 to electrically connect with the second ground shield 80B. In one particular embodiment, there may be four ground connectors 128 located adjacent edge 100 and four ground connectors located adjacent edge 102. However, any number of ground connectors extending through the card 12 to electrically connect the first ground shield 80A with the second ground shield 80B is entirely possible. Furthermore, a plurality of additional ground connectors 128 may be positioned adjacent edge 120 and edge 122 on ground shield 80A and electrically connect with the second ground shield 80B.

As mentioned briefly above, ground shield 80 may be a unibody that is integrally extruded, molded, or formed as a unitary, monolithic member substantially fabricated from a rigid, natural or manmade, material. In one example, metal or metal alloys, such as copper, gold, other alloys, may form a substantial majority of the components or elements used to fabricate the ground shield 80 and the various components integrally formed, molded, or extruded therewith. The ground shield 80 should withstand typical integrated circuit operation enabling electrical current to be conducted therethrough. While it is contemplated that the ground shield 80 and its additional connecting components described herein are uniformly and integrally extruded, molded, or formed, it is entirely possible that the components of the tool body be formed separately from alternative materials as one having routine skill in the art would understand. Furthermore, while the components of the ground shield 80 are discussed below individually (i.e., the edges, surfaces, and dimensions), it is to be clearly understood that the components and their corresponding reference elements of the ground shield 80 are portions, regions, or surfaces of the body and all form a respective element or component of the unitary ground shield 80. Thus, while the components may be discussed individually and identified relative to other elements or components of the ground shield 80, in this exemplary embodiment, there is a single ground shield 80 having the above described portions, regions, and/or surfaces.

With continued reference to ground shield 80, the intermediate horizontal first and second edges 110, 116 respectively define shoulders on the ground shields 80A, 80B. These shoulders defined by edges 110, 116 extend inwardly to define a edge. As indicated by dimension 104, the ground shield 80 is wider above the shoulder defined by the edge established by edges 110, 116 and is narrower below the shoulder as shown by dimension 126. In one particular embodiment, dimension 104 is approximately three times greater than dimension 126. However, the ratio of the larger dimension 104 to the narrower dimension 126 may be in a range from about 1.25:1 to about 4:1. Alternatively, in other aspects it may be possible to eliminate the shoulder such that the ground shield 80 has a continuous width from the upper end 82 to the lower end 84.

Typically, it is desirable to limit the amount of resonances occurring on the balun 14. Resonances that are limited or reduced based on the ground shield 80 on the PCB substrate 16 are based on the coupling between adjacent signal lines for each respective adjacent balun 14. In one alternative embodiment, with respect to the rejection loops 52, 58 and the ground shield 80, rather than only covering the balun 14, shield 80 could cover the balun 14 and the rejection loops 52, 58 (which sometimes may be considered resistive feed arms) on or in the PCB substrate 16.

Figure 4:
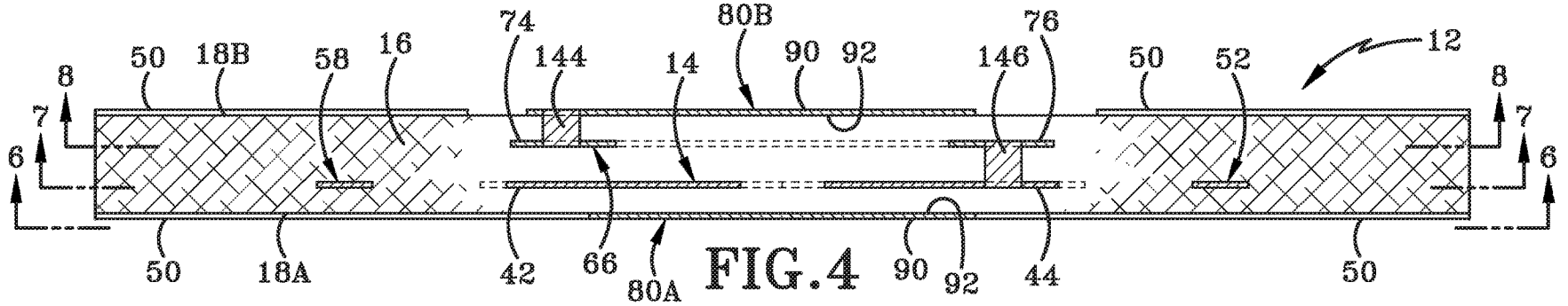
FIG. 4 is a transverse cross section view of the antenna card taken along line 4-4 in FIG. 1.

FIG. 3 through FIG. 5 depict transverse cross sections of the card 12 in which the electrically conductive layers of the ground shields 80A, 80B are positioned exteriorly from the balun 14 and the stripline feed 66. The substrate 16 has the first surface 18A opposite a second surface 18B. First surface 18 and second surface 18B define major surface areas of the card 12. A minor surface area 132 of the card is defined by a first edge 134 and an opposing edge 136 defined by the thickness of the card 12 between the first surface 18 and the second surface 18B. In one particular embodiment, the stripline feed 66 and the balun 14 are embedded within the substrate 16. In one particular embodiment, substrate 16 is a dielectric material that has electrical insulative properties. The first ground shield 80A may be substantially coplanar or conformal with first surface 18 of substrate 16. First surface 90 of ground shield 80A may face outwardly from card 12. Second surface 92 of ground shield 80A may face inwardly towards the stripline feed 66, the balun 14, and the second ground shield 80B.

A portion 138 of the dielectric material forming the substrate 16 is positioned between the second surface 92 of first ground shield 80A and the stripline feed 66. Ground connectors 128 electrically connect the first ground shield 80A with the second ground shield 80B but are not electrically connected with the stripline feed 66. Another portion on balun 14 of the dielectric material forming the substrate 16 is positioned between the stripline feed 66 and the balun 14. In this particular embodiment, both the stripline feed 66 and the balun 14 are embedded within the substrate 16. Another portion 142 of dielectric material of the substrate 16 may be positioned between the balun 14 and the first surface 90 of the second ground shield 80B. Accordingly, the second ground shield 80B may have its second surface 92 be substantially conformal or coplanar with the second surface 18B of the substrate 16. A first via 144 may be electrically connected with the stripline feed 66 at its first terminal 74. First via 144 may be used as a ground via. However, other electrical uses of the via 144 are entirely possible. A second via 146 may electrically connect the stripline 66 to the balun 14. More particularly, via 146 may connect the second terminal end 76 with the second tuning stub 44 on balun 14.

The ground shields 80A, 80B cover the balun 14 and the stripline feed 66 embedded within the substrate 16. The configurations of the ground shields 80A, 80B may be varied to meet certain application's specific needs. Thus, the shape of the ground shields 80A, 80B may be varied without departing from the scope of the present disclosure. For example, it may be possible to entirely cover the first surface 18 and the second surface 18B of the substrate 16 with ground shields. However, it is believed that the shape of ground shields 80A, 80B will sufficiently protect signals moving through the stripline feed 66 and the balun 14 from coupling to adjacent antenna unit cells or adjacent antenna cards (i.e., the second antenna card 12B depicted in FIG. 9) while sufficiently minimizing the amount of electrically conductive material, such as copper, that is used to form the ground shields 80A, 80B.

Substrate 16 is formed from dielectric material or layer that insulates between each respective metallic or conductive layer of the PCB or antenna card 12. Stated otherwise, the ground shield 80 is etched directly on the dielectric material in the PCB of the antenna card 12. The dielectric material acts as in insulator to provide dielectric loading between each of the electrically conductive layers which affects the characteristic impedance of the line.

With continued reference to the cross-section views of FIG. 3-FIG. 5, the dielectric material of substrate 16 can be any material that has a dielectric constant between about 2.2 and about 10 or 20 which affects the characteristic impedance of the signal lines. The two ground shields 80A, 80B share a common ground reference through vias 128 connecting the two ground shields 80A, 80B together. The width of the signal line or stripline feed is different than that of the differential arms 20, 22 of the balun 14. In one particular embodiment, the width of the stripline feed 66 or signal line is greater because the dielectric thickness between one ground shield 80 and the width of the strip line affect the characteristic impedance of the signal line or stripline feed 66. This sets the input impedance to the system which is desired to be at 50 ohms. However, a difference system impedance is required, then the dielectric thickness and the width of the signal line may be varied to accomplish a different system impedance. The thickness, when viewed in cross-section, of the dielectric material may be varied or adjusted between the ground and the signal line or the signal line and the differential in order to realize a characteristic impedance of the desired system. This enables the assembly of the present disclosure to transform from 50 ohms to 100 ohms differential.

Figure 9:
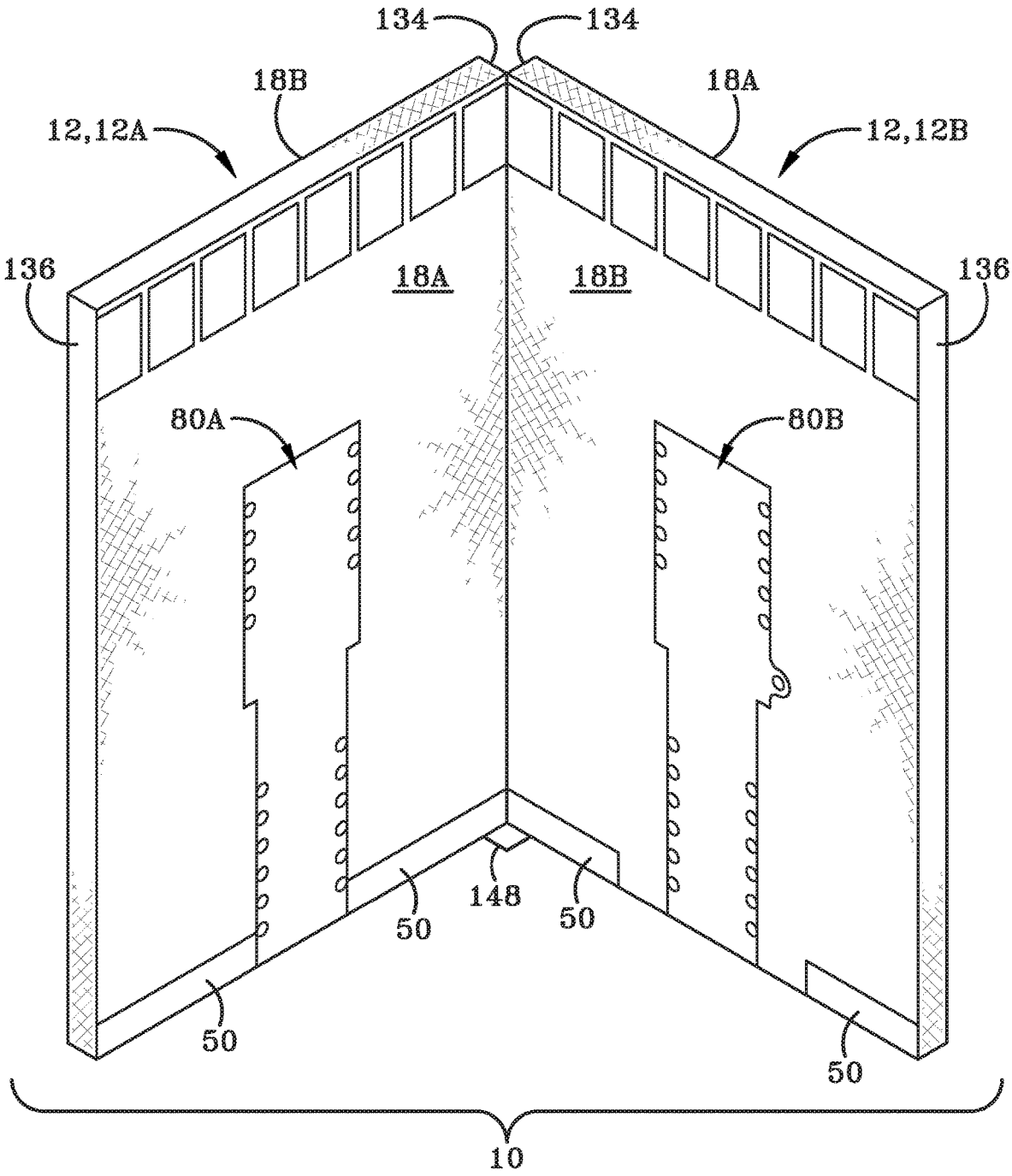
FIG. 9 is a top perspective view of two antenna cards orthogonally connected to form a portion of an antenna unit cell.

With continued reference to FIG. 3-FIG. 5, the first major surface 90 of the first ground shield 80A lies along a first plane and the second major surface 92 of the first ground shield 80A lies along a second plane, and the first and second planes are offset parallel to one another. The first major surface 90 of the second ground shield 80B lies along a third plane and the second major surface 92 of the second ground shield 80B lies along a fourth plane, and the third and fourth planes are offset parallel to one another. In one embodiment, the first and second planes are parallel with the third and fourth planes FIG. 9 depicts the antenna unit cell 10 formed of two orthogonally intersected antenna cards 12A, 12B. The orthogonal connection of first card 12A to second card 12B is depicted through the right angle 148. The dipole radiating arms on the first card 12A establish a horizontal polarization when the antenna unit cell 10 is operational. The dipole arms on the second card 12B establish a vertical polarization when the antenna unit cell 10 is operational. A plurality of antenna unit cells 110 may be joined together to form a modular dipole array antenna assembly. The antenna unit cell 10 defines an aperture with the integrated balun 14 having ground shields 80A, 80B eliminates the need for bulky, expensive commercial off the shelf baluns. Further the antenna unit cell should improve cross polarization performance of a dual polarized antenna element because the ground shields 80A, 80B enhance isolation to eliminate or reduce the likelihood of signal coupling between adjacent antenna elements or cards 12A, 12B. Unit cell 10 may be connected with other similar unit cells to form an N×N modular Card Tightly Coupled Dipole Array (TCDA) Assembly, where N may be any integer. In one particularly embodiment, the TCDA Assembly is an 8×8 Modular Card TCDA Assembly.

In accordance with one aspect of the present disclosure, the antenna assembly disclosed herein includes the grounded shield 80 covering a portion of the balun 40 connected to the radiating antenna elements 32, 34. Shield 80 shields the signal line or stripline feed 66 so the antenna assembly does not interfere with an adjoining antenna element or card 12 operating in the N×N array assembly. In an N×N antenna array, there are a plurality of radiating elements 32, 34 operating in close proximity to each other and in order to extend or increase the bandwidth of the plurality of radiating elements. In an exemplary TCDA antenna, the dipole radiating elements 32, 34 are each fed by baluns 14. Without the ground shielded antenna, the signal lines or feed 66 connected to each balun 14 will couple based on the proximity of the baluns 14 relative to each other. Thus, in accordance with one aspect of the present disclosure, the grounded shield 80 shields the signal line connected to each balun to prevent signals from adjacent signal lines from coupling. Thus, the present disclosure limits or mitigates the coupling between adjacent baluns in the TCDA assembly.

The shielding accomplished by shield 80 (or the combination of first and second shields 80A, 80B) of the present disclosure is operative to prevent coupling inasmuch as signals and signal lines that are closer enough to each other have a tendency to couple to each other. When signals from adjacent signal lines or feeds 66 couple to each other, they create unwanted resonances or harmonics or spurious signals in the frequency of operation band. Limiting the resonances in the frequency band of operation is beneficial to ensure that the radiation efficiency is not unduly burdened or decreased for the aperture. Another exemplary reason is for signal integrity because any two lines that are close to each other and trying to pass signals through each respective line and if the signals couple, then signal integrity issues are created.

In accordance with another aspect of the present disclosure, the TCDA assembly formed from unit cell 10 having card 12 is able to realize dual polarization by a plurality of antenna elements in the cluster that define the array. In one particular embodiment, the cluster has two perpendicular dipoles (i.e., orthogonal radiating arms on adjacent cards 12) to realize dual polarization or apertures. In one exemplary embodiment, the TCDA assembly may an 8×8 which refers to having eight by eight antenna unit cells. Each antenna unit cell has two printed dipoles with two baluns. Thus, there are 128 baluns in the TCDA assembly (64 times two baluns=128 baluns). Each antenna radiating element on card 12 is fed by a balun 14. Dual polarization is implemented when the radiating elements are orthogonal to each other. Stated otherwise, there is arbitrary polarization, such as dual, linear, horizontal, and vertical polarization for the aperture. In accordance with another aspect of the present disclosure, this technology of ground shielding the balun 14 can be implemented with a polarized array. The balun is agnostic regardless of the radiating element attached to the same. Thus, the grounded shield 80 can be considered agnostic as well regardless of whether the balun is coupled to linear radiating elements or circularly polarized radiating elements.

In accordance with one aspect of the present disclosure, the assembly depicted herein can meet design requirements for a voltage standing wave ratio (VSWR) less than three. In accordance with another aspect of the present disclosure, the assembly provided herein is a no touch labor solution inasmuch as it is on a printed circuit card and once the design is provided to a PCB vendor, no additional assembly is required except for small minor connectors that utilized to install the card.

Figure 10:
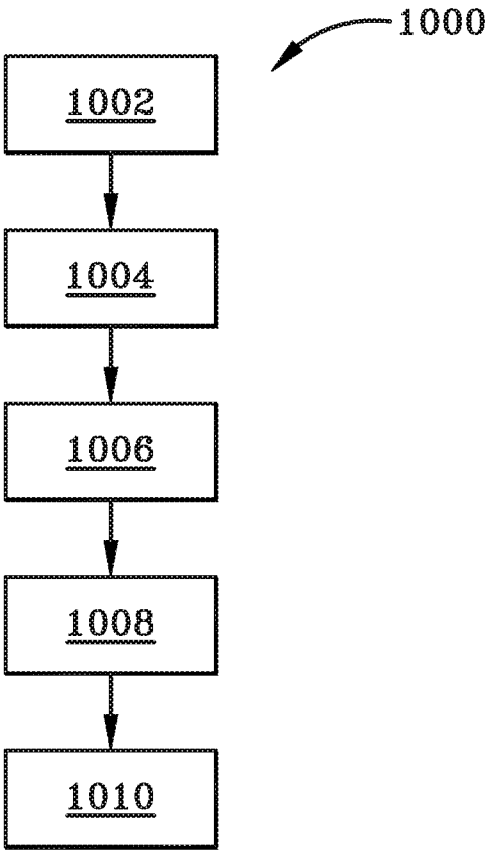
FIG. 10 is a flow chart depicting an exemplary method or process in accordance with one aspect of the present disclosure.

FIG. 10 depicts an exemplary operation of a method or process in accordance with the present disclosure generally at 1000. By way of example, the method 1000 may include providing an N×N TCDA antenna assembly formed from a plurality of unit cells 10 having orthogonally aligned antenna cards 12A, 12B formed from substrate 16. The cards 12 may be assembled or fabricated in manner such that a first ground shield 80A is conformal or covers a portion or all of a first major surface of the substrate 16 and a second ground shield 80B is conformal or covers a portion or all of an opposing second major surface of the substrate 16. The method 1000 includes feeding a differential signal is into a stripline feed 66 embedded in the substrate and connected with the balun 14, which is shown generally at 1002. The differential signal flows through the balun 14 and flows into the radiating element or dipole arms 32, 34. During the differential signal flowing through the radiating elements, another differential signal is flowing into an identical second antenna card 12B that is orthogonal to the first antenna card 12A, which is shown generally at 1004. Due to the close physical proximity of the cards 12A, 12B that collectively define one antenna unit cell 10 in the TCDA antenna assembly, the differential signals flowing along respective stripline feeds 66 in each 12A, 12B will have a tendency to couple. The shields 80A, 80B are grounded and electrically connected to each other on each respective card. Thus, grounding two electrically connected shields 80A, 80B on each card 12 is shown generally at 1006.

The method 1000 further includes, by way of the grounded shields 80A, 80B, precluding or inhibiting (or otherwise reducing the ability) signals traveling through adjacent stripfeed lines 66 from coupling, which is shown generally at 1008. This preclusion of signal coupling is accomplished by the physical presence and installation of the ground shields 80A, 80B being located exteriorly from the balun 14 and the stripfeed line 66 which are embedded in the substrate 16. The shape of each shield 80 can be in form of what is described herein, however other shapes are entirely possible. Then, continuing operation of the TCDA antenna assembly while precluding signal coupling is shown generally at 1010.

During the method 1000 of operation, card 12 on unit cell 10 of TCDA antenna assembly is operative in a frequency band having a limited number or no spurious resonant signals as a result of the ground shields 80A, 80B enhancing isolation of the balun 14 and signal line (i.e., stripline feed 66) relative to other adjacent baluns and stripline feeds. By way of example, the stripline feed may receive a differential signal through its conductive portion in at a first frequency or within a first frequency band.

Prior to operation, the antenna card 12 may be fabricated in an efficient manner having the ground shields 80A, 80B printed on the substrate during its manufacture. Stated otherwise, when the card is embodied as a PCB, the two ground shields may be printed as a layer of the circuit board. Thus, the card 12 in the form of a PCB would be considered a four-layer PCB. Namely, the four layers of the card 12 would be the two outer ground shields 80A, 80B, the balun 14 and radiating elements 32, 34, and the stripline feed 66.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in conjunction with antenna software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the antenna software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as antenna software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "antenna program" or "antenna software" or "instructions" are used herein in a generic sense to refer to any type of computer code or set of computer-executable instructions that can be employed to program a computer or other processor to implement various aspects of embodiments relating to TCDA antenna assembly operation as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable antenna instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment,"

"an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. An antenna element comprising:

a radiating element;

a balun connected to the radiating element;

a first ground shield that is substantially parallel to a first major surface of the balun adapted to enhance isolation of the balun by reducing a likelihood that a signal transmitting through the balun couples with signals transmitting through other baluns on adjacent antenna elements; and a stripline feed coupled to the balun feeding a signal to the balun, wherein the first ground shield is operative to shield the signal from coupling with other signals from other signal lines feeding signals to the other baluns on adjacent antenna elements, and wherein the antenna element is operative in a frequency band having a limited number or no spurious resonant signals as a result of the first ground shield enhancing isolation of the balun and the stripline feed relative to the other baluns on adjacent antenna elements or another stripline feed on adjacent antenna elements.

2. The antenna element of claim 1, further comprising:

a second ground shield that is substantially parallel to a second major surface of the balun on an opposing side of the balun than the first ground shield.

3. The antenna element of claim 2, further comprising:

a first major surface and a second major surface of the first ground shield, and a minor surface of the first ground shield defined by a thickness of the first ground shield from the first major surface to the second major surface forming an edge; and wherein the first major surface of the first ground shield lies along a first plane and the second major surface of the first ground shield lies along a second plane, and the first and second planes are offset parallel to one another;

a first major surface and a second major surface of the second ground shield, and a minor surface of the second ground shield defined by a thickness of the second ground shield from the first major surface to the second major surface area forming an edge;

wherein the first major surface of the second ground shield lies along a third plane and the second major surface of the second ground shield lies along a fourth plane, and the third and fourth planes are offset parallel to one another; and the first and second planes are parallel with the third and fourth planes.

4. The antenna element of claim 3, wherein the second major surface area of the first ground shield faces the first major surface area of the second ground shield.

5. The antenna element of claim 1, wherein the first ground shield comprises copper.

6. The antenna element of claim 1, further comprising:

a trace line or via that electrically connects the first ground shield to the balun.

7. The antenna element of claim 1, further comprising:

a second ground shield that is substantially planar covering the balun on an opposing side of the balun than the first ground shield;

a first trace line or via that electrically connects the first ground shield to the balun; and a second trace line or via that electrically connects the second ground shield to the balun.

8. The antenna element of claim 1, further comprising:

a first end and a second end of the first ground shield, wherein the first end of the first ground shield is wider than the second end of the first ground shield.

9. The antenna element of claim 8, wherein the first end of the first ground shield is associated with a top of the first ground shield and the second end is associated with a bottom of the first ground shield.

10. The antenna element of claim 9, further comprising:

a shoulder on the first ground shield that extends inwardly to define an edge, wherein the first ground shield is wider above the shoulder and narrower below the shoulder.

11. The antenna element of claim 10, further comprising:

outer edges of the first ground shield that are orthogonal to the shoulder, wherein the outer edge of the first ground shield above the shoulder are spaced apart wider than the outer edge of the first ground shield below the shoulder.

12. The antenna element of claim 1, further comprising:

a common ground; and a second ground shield that is substantially planar covering the balun on an opposing side of the balun than the first ground shield;

wherein both the first ground shield and the second ground shield are electrically connected to the common ground.

13. The antenna element of claim 12, wherein the common ground is associated with a lower end of the antenna element.

14. The antenna element of claim 1, further comprising:

a first resistive feed arm operatively connected to a first differential on the balun; and a second resistive feed arm operatively connect to a second differential on the balun;

wherein the first ground shield covers both the balun and at least a portion of the first and second resistive feed arms.

15. The antenna element of claim 1, further comprising:

a second ground shield that is substantially planar covering the balun on an opposing side of the balun than the first ground shield;

a differential signal line;

a first portion of dielectric material between the first ground shield and the differential signal line;

a second portion of dielectric material between the differential line and the balun; and a third portion of dielectric material between the balun and the second ground shield.

16. The antenna element of claim 15, further comprising:

at least one common ground electrically connecting the first ground shield to the second ground shield;

a first via electrically connected to a first differential on the balun; and a second via electrically connecting a second differential on the balun to the differential signal line.

17. The antenna element of claim 16, further comprising:

when viewed in cross section, a width of the differential signal line that is different than a width of the balun.

18. A method of operating an antenna element on an antenna array assembly comprising:

feeding a signal into a stripline feed embedded in a substrate of a first antenna card of the antenna element and connected with a balun, and feeding the signal to a radiating element on the first antenna card;

feeding a signal into a stripline feed embedded in a substrate of a second antenna card of the antenna element and connected with a balun, wherein the second antenna card is orthogonal to the first antenna card, and feeding the signal to a radiating element on the second antenna card;

grounding two electrically connected ground shields on each card that cover the balun on each respective antenna card, wherein the ground shields are adapted to enhance isolation of the balun by reducing a likelihood that a signal transmitting through the balun couples with signals transmitting through other baluns on adjacent antenna elements; and inhibiting, by the ground shields, adjacent signals traveling through adjacent stripfeed lines on the first and second antenna cards from coupling.

19. An antenna element comprising:

a radiating element;

a balun connected to the radiating element;

a first ground shield that is substantially parallel to a first major surface of the balun adapted to enhance isolation of the balun by reducing a likelihood that a signal transmitting through the balun couples with signals transmitting through other baluns on adjacent antenna;

a first resistive feed arm operatively connected to a first differential on the balun; and a second resistive feed arm operatively connect to a second differential on the balun;

wherein the first ground shield covers both the balun and at least a portion of the first and second resistive feed arms.

* * * * *